US009254637B2

(12) United States Patent
Serenius et al.

(10) Patent No.: US 9,254,637 B2
(45) Date of Patent: Feb. 9, 2016

(54) REAL-TIME VIRTUAL PROOFING SYSTEM AND METHOD FOR GRAVURE ENGRAVER

(71) Applicants: Eric Serenius, Springboro, OH (US); Gaurav Bedi, Centerville, OH (US)

(72) Inventors: Eric Serenius, Springboro, OH (US); Gaurav Bedi, Centerville, OH (US)

(73) Assignee: Ohio Gravure Technologies, Inc., Miamisburg, OH (US)

( * ) Notice: Subject to any disclaimer, the term of this patent is extended or adjusted under 35 U.S.C. 154(b) by 0 days.

(21) Appl. No.: 14/038,879

(22) Filed: Sep. 27, 2013

(65) Prior Publication Data

US 2015/0092243 A1 Apr. 2, 2015

(51) Int. Cl.
*B41C 1/045* (2006.01)

(52) U.S. Cl.
CPC ..... *B41C 1/045* (2013.01)

(58) Field of Classification Search
USPC ..... 358/3.29
See application file for complete search history.

(56) References Cited

U.S. PATENT DOCUMENTS

| | | | | |
|---|---|---|---|---|
| 5,424,845 | A | 6/1995 | Holowko et al. | |
| 5,438,422 | A | 8/1995 | Holowko et al. | |
| 5,440,398 | A | 8/1995 | Holowko et al. | |
| 5,492,057 | A | 2/1996 | Bornhors, Jr. et al. | |
| 5,528,515 | A * | 6/1996 | Hayashi | 399/181 |
| 5,663,802 | A | 9/1997 | Beckett et al. | |
| 5,671,063 | A | 9/1997 | Auberry et al. | |
| 5,737,090 | A | 4/1998 | Christopher et al. | |
| 5,818,605 | A * | 10/1998 | Crewe et al. | 358/3.29 |
| 5,825,503 | A | 10/1998 | Brewer et al. | |
| 5,828,464 | A * | 10/1998 | Yoshida et al. | 358/3.29 |
| 5,831,746 | A | 11/1998 | Seitz et al. | |
| 5,894,354 | A | 4/1999 | Beckett et al. | |
| 6,348,979 | B1 | 2/2002 | Flannery et al. | |
| 6,614,558 | B1 | 9/2003 | Christopher et al. | |
| 6,768,561 | B1 * | 7/2004 | Fangmeyer et al. | 358/3.29 |
| 2006/0279793 | A1 * | 12/2006 | Jurgensen | 358/3.29 |

* cited by examiner

*Primary Examiner* — Ngon Nguyen
(74) *Attorney, Agent, or Firm* — Jacox, Meckstroth & Jenkins

(57) ABSTRACT

A virtual, real-time proofing system and method are shown. The system and method are characterized in that a reconstructed image of a plurality of engraved cells is created using a pixel data signal that is created using a tool path position signal generated by a sensor that senses the movement of a cutter or stylus as it is engraving the cells.

26 Claims, 19 Drawing Sheets

FIG 4A Overall Real-time Tool Path Virtual Proofing System Flowchart
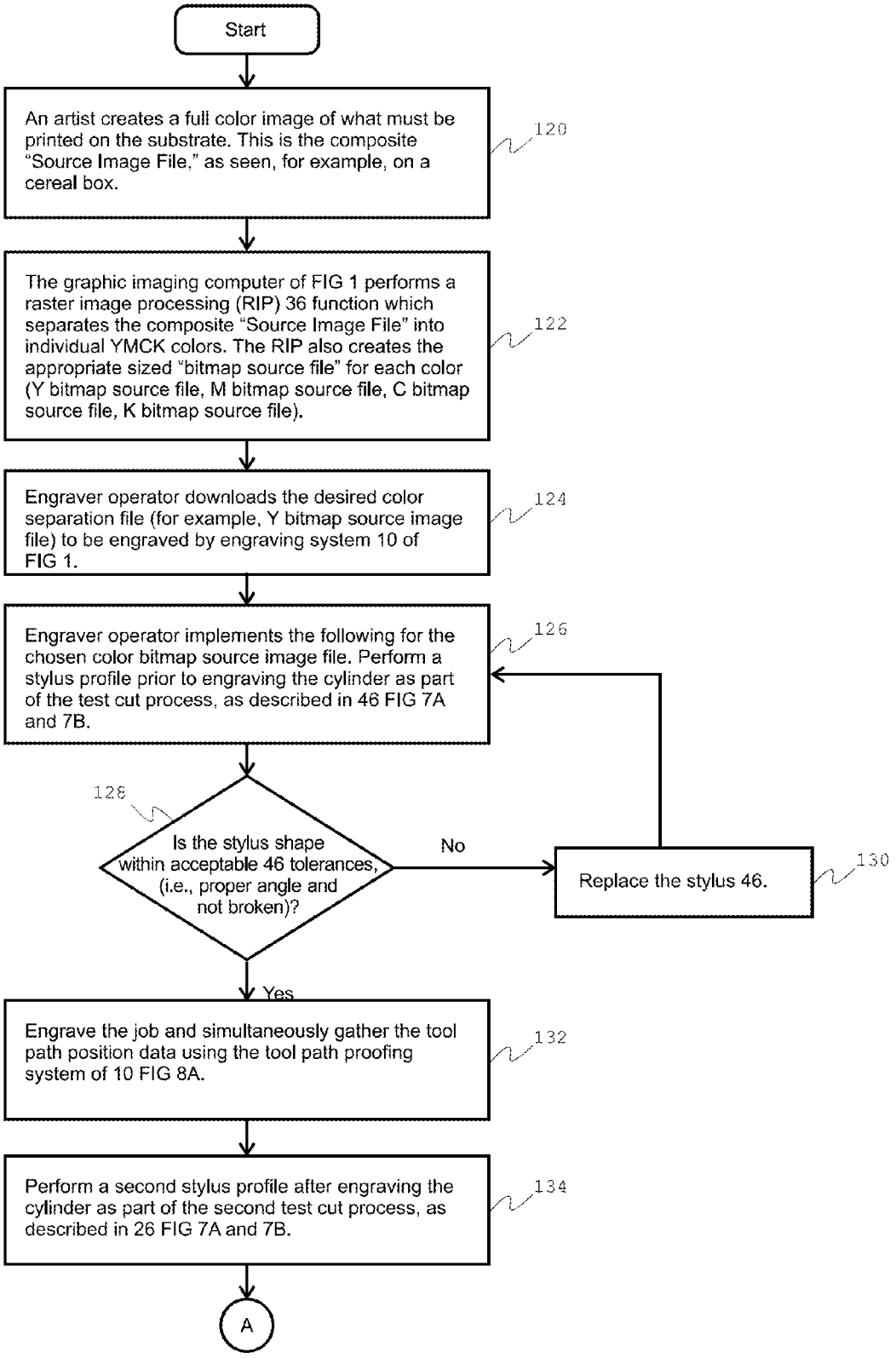

FIG 5 Stylus Depth to Width Relationship
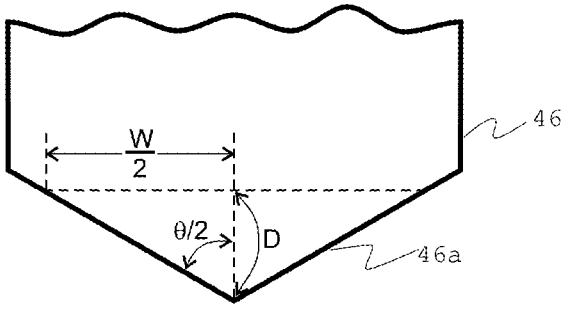
$W = 2D \tan(\theta/2)$
where: D = cell depth
W = cell width
θ = stylus angle FIG 7A Stylus Profile Method
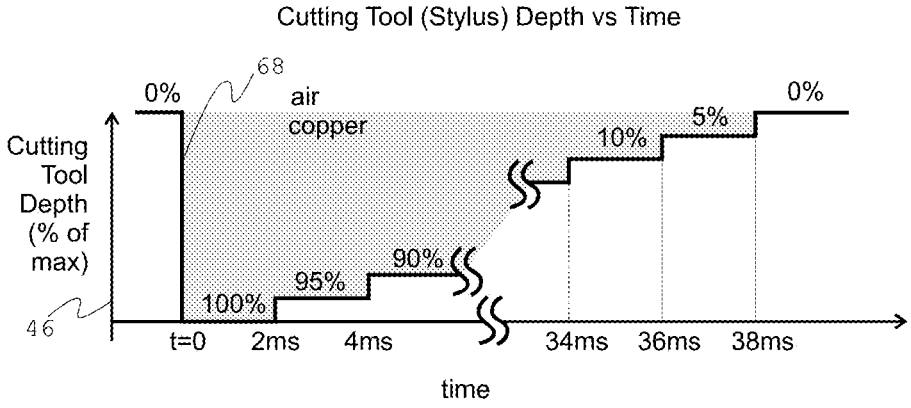
PRIOR ART FIG 7B Resultant Cell Width vs Time
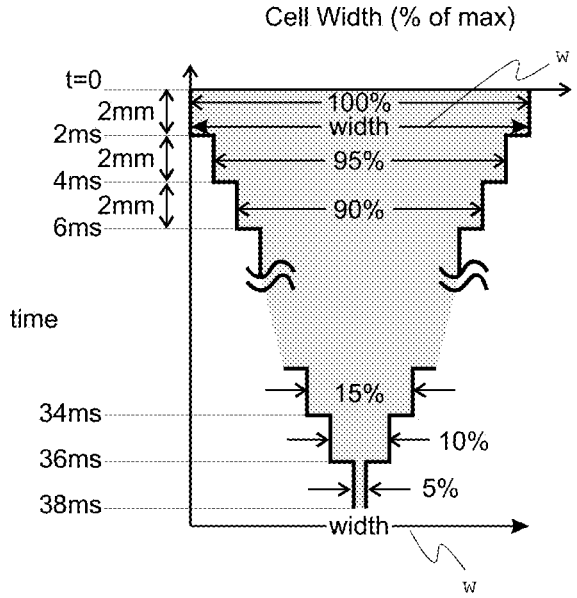
PRIOR ART FIG 7C Calculated tool profile from test cuts
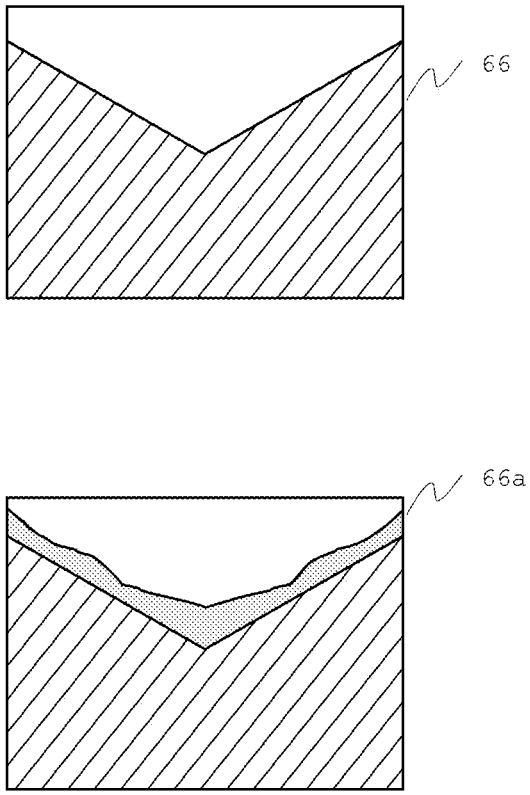

FIG 8A Tool Path Proofing Hardware and Signal Diagram
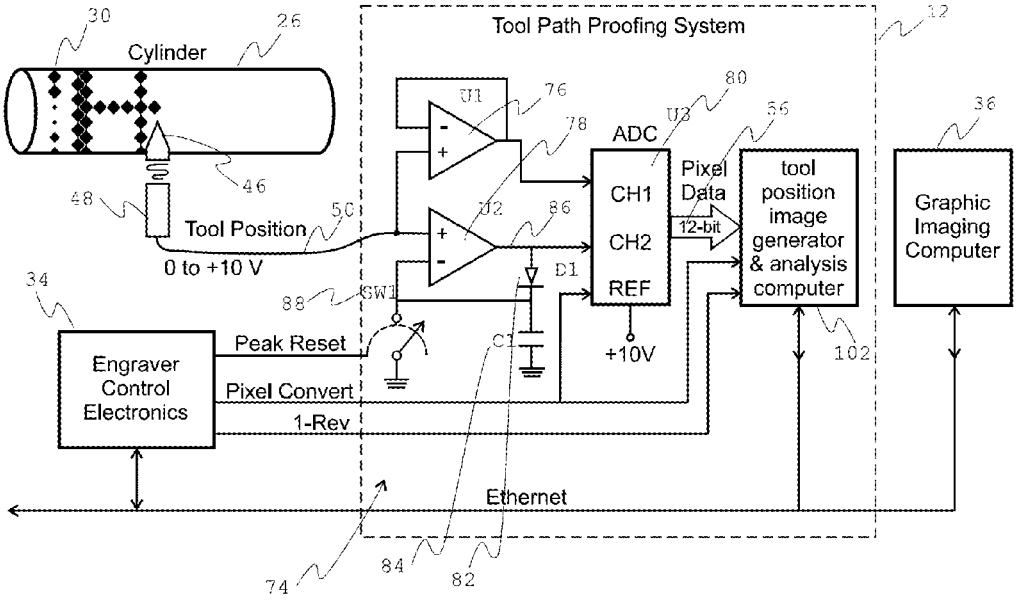

FIG 9 Screens and Cell/Pixel Value with Nested Cells
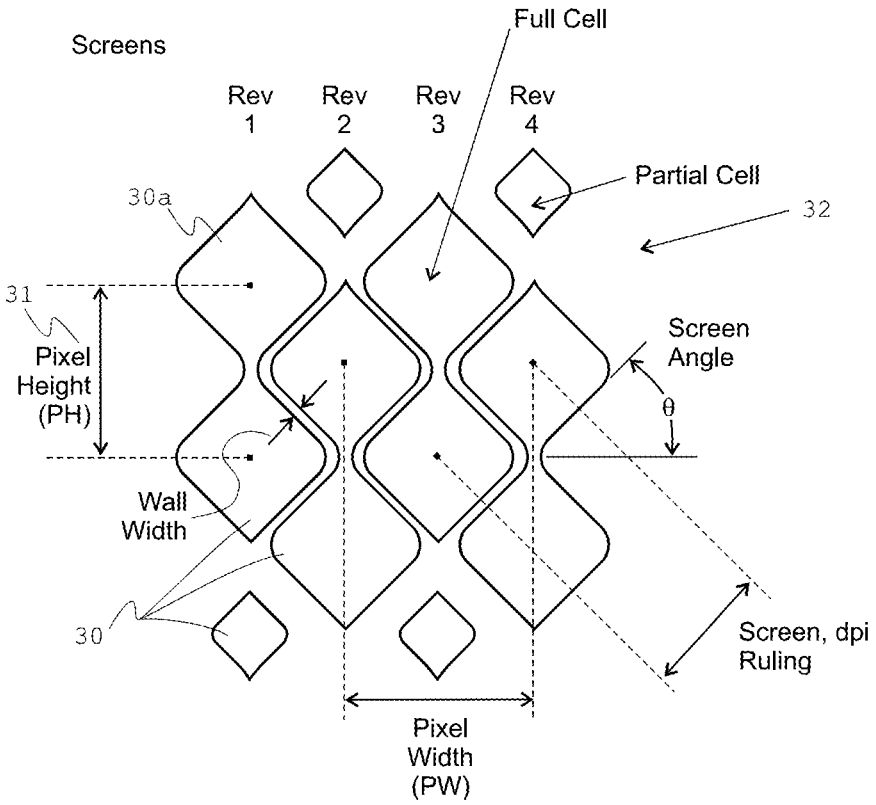
PRIOR ART

FIG 10A Engraver Tool Position Reconstructed Image 90
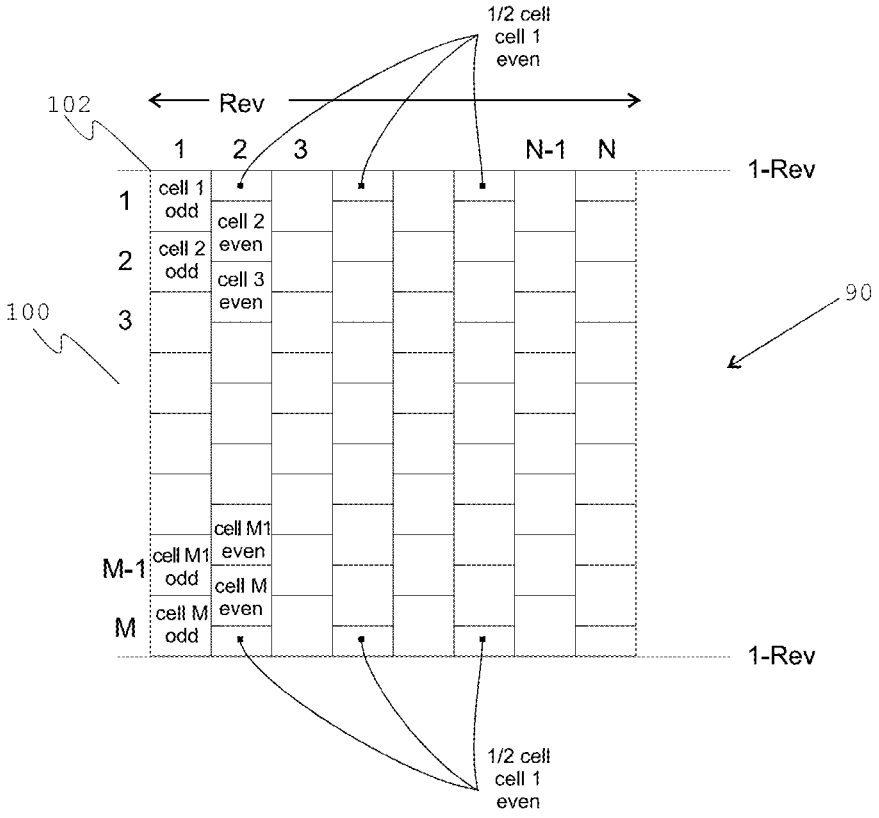

FIG 10B Pixel Data for Odd and Even Revs
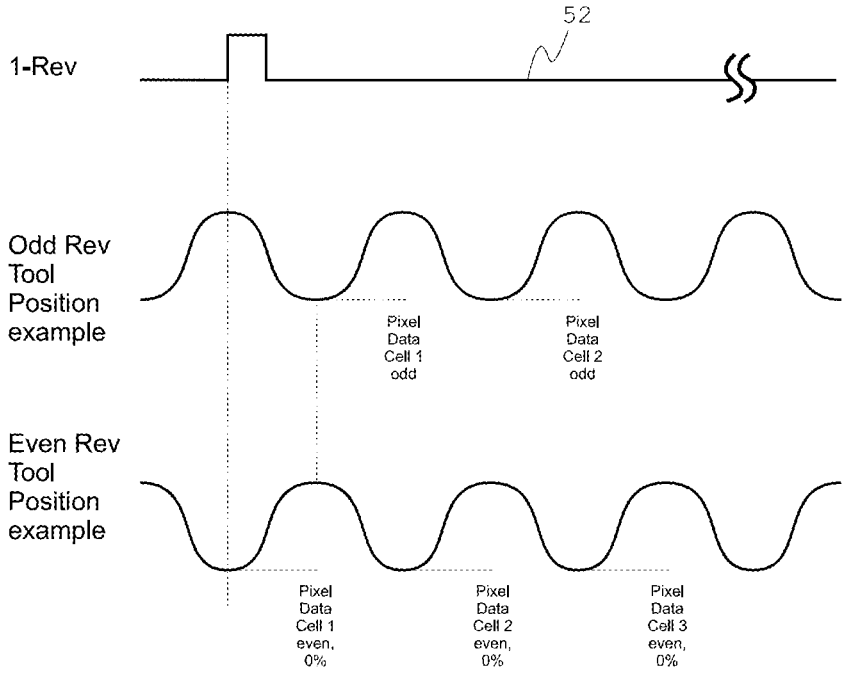

FIG 10C Engraver Tool Position Reconstructed Image 90
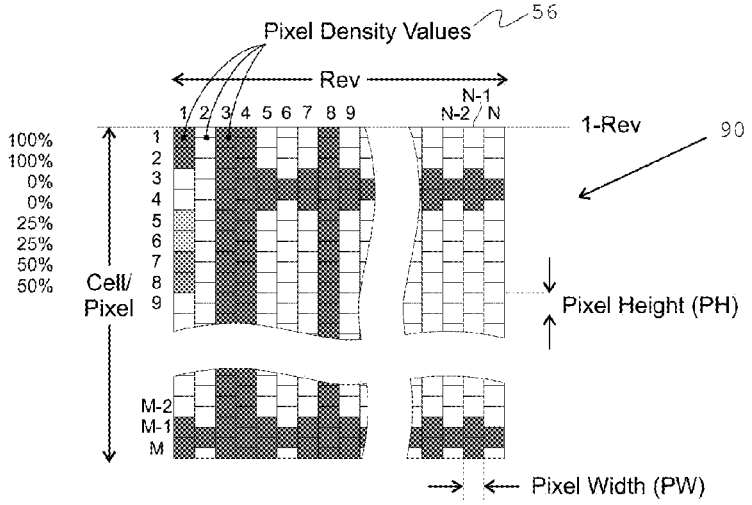
Bitmap Source Image File
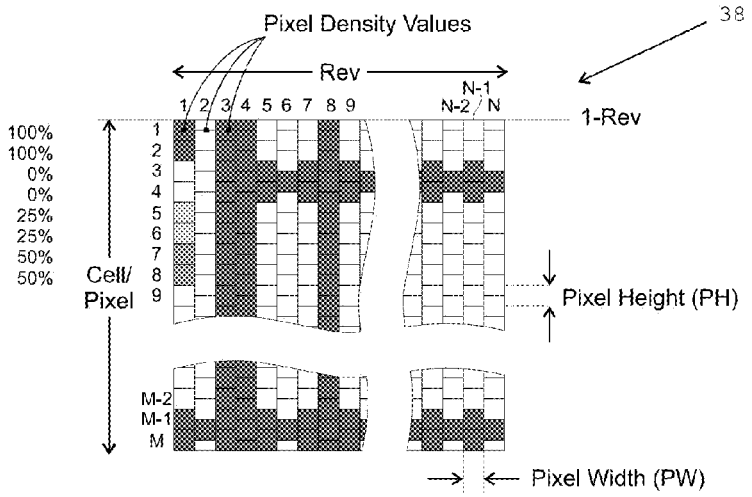
Reconstruction to Source Difference Image or Proofing Result Report
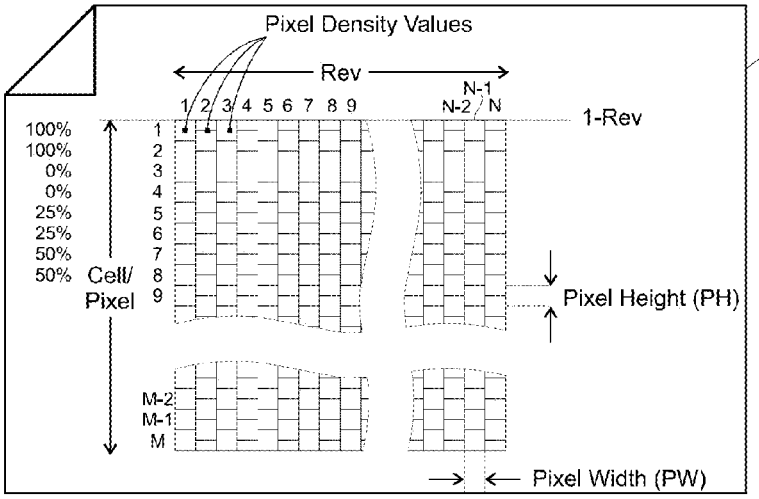
Zero everywhere.
No difference. This is
the ideal case.

FIG 10D Engraver Tool Position Reconstructed Image 90
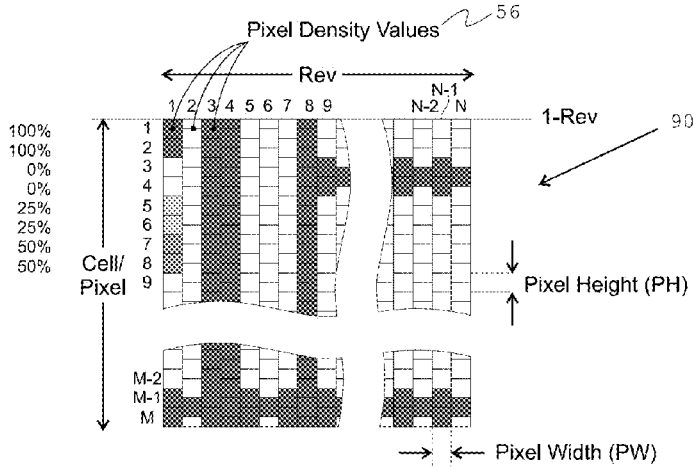
Bitmap Source Image File
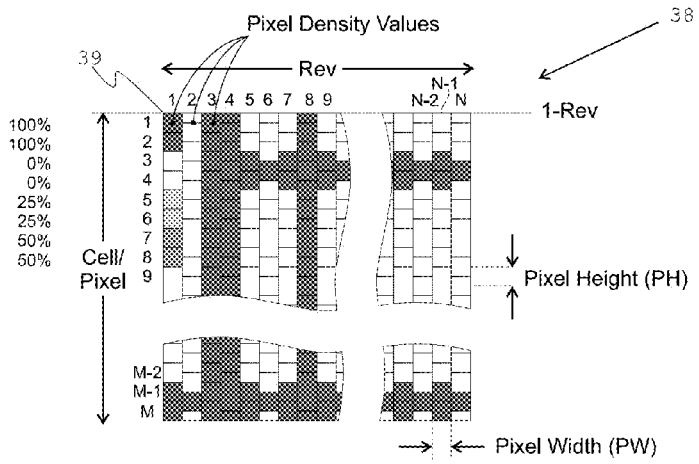
Reconstruction to Source Difference Image
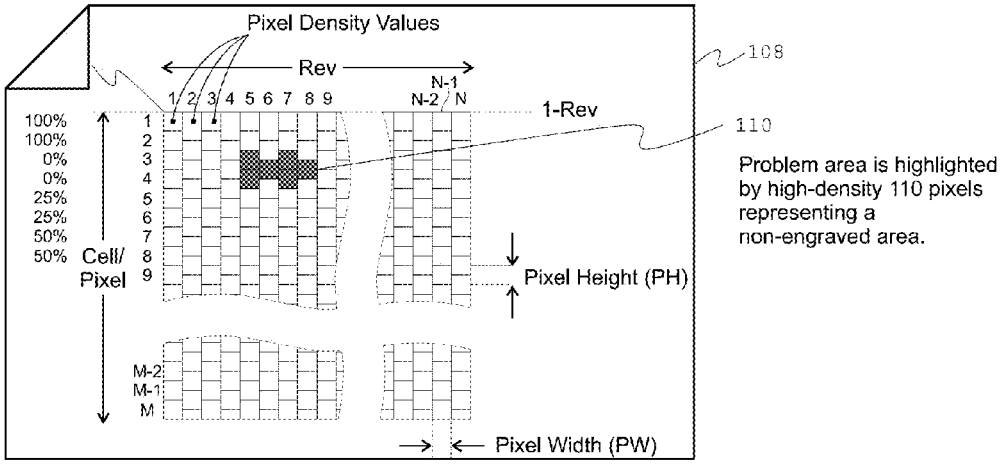

REAL-TIME VIRTUAL PROOFING SYSTEM AND METHOD FOR GRAVURE ENGRAVER

BACKGROUND OF THE INVENTION

1. Field of the Invention

This invention relates to a gravure engraver and, more particularly, to an engraver having a real-time tool path virtual proofing system and method.

2. Description of the Related Art

The gravure printing process is an additive process which typically involves at least four colors and henceforth cylinders, one for each color (yellow, magenta, cyan and black or key). It is not uncommon that spot colors are used, in addition, to obtain a very consistent color, such as the orange color used on a Tide® detergent box. To create a composite test proof, each cylinder is inked and used to print on a substrate. Registering the cylinders and performing the test proof substrate is, again, very time consuming and labor intensive. Thus, traditional workflow of gravure printing involves creating a full color proof on a proof press prior to the engraved cylinders being released to high volume production press. Creating a full color test proof is an expensive and time consuming process. This also puts gravure printing at a disadvantage compared to other types of printing processes, such as flexographic printing.

Proof presses are used as a quality check prior to committing the cylinders to production. The process involves the following steps for each of the YMCK cylinders: using a crane to install the cylinder in the proof press, aligning the cylinder to the substrate, aligning the doctor blade for wiping the ink, mixing the ink to ensure proper viscosity, inking the cylinder, running this one color print, cleaning the cylinder and doctor blade of excess ink, and removing the cylinder. These steps are repeated for each color where each color is registered to previous colors to obtain the desired composite image. Performing these steps for four colors takes an experienced operator one or more hours. Most, if not all, gravure cylinder facilities have multiple proofing presses and employ dedicated people for this quality step. As is apparent, the process is time consuming and expensive.

Different approaches for eliminating the expensive proofing step have been sought after for many years. For example, capturing images of the engraved pattern using cameras and other techniques to provide an optical or visual inspection of the cylinders has been attempted in the past. An Israeli company, PSik Solutions, Ltd., offered the idea of an optical visual inspection system in 2011, but the implementation has not been economically practical. Unfortunately, these approaches are impractical due to the image capture and computer processing speed limitations. Although theoretically possible, the development costs for such a system is prohibitive for this market. These approaches are also expensive and oftentimes require large amounts of processing capability.

Accordingly, there is a need for an improved proofing system and method that reduces or eliminates traditional proofing processes of the past.

SUMMARY OF THE INVENTION

One object of one embodiment of the invention is to provide a proofing system and method that improves over the traditional proofing techniques used in the past.

Another object of one embodiment of the invention is to provide a proofing system that is adapted to utilize the real-time sensed actual movement of the cutter or stylus.

Still another object is to provide a system and method that permits a digital or visual proof of a cylinder or cylinder set without the need to perform a traditional proofing.

Still another object is to provide a digital virtual proofing method and system that is responsive to a cutting motion of a cutter or stylus and that reduces or eliminates the need to use traditional proofing techniques.

Yet another object is to provide an actual real-time signal that is directly in response to the actual motion and movement of the cutter or stylus which can be used to reconstruct a cut image or reconstructed image that can be compared to the source image. Furthermore, this reconstructed image will be created and analyzed while the image is being engraved. This means that the operator will have an early (or real-time) indication of problems or confidence that the work or engraving is progressing as expected. A monitor on the engraver will display the reconstructed image and the difference image in real-time.

Still another object is to provide a tool path proofing circuit adapted to create a pixel data signal that is directly related or responsive to the movement of the cutter or stylus that and provides an accurate representation of the plurality of cells, and even the cell shape, engraved on the cylinder.

In one aspect, one embodiment of the invention comprises a proofing system for proofing an image engraved on a gravure cylinder, at least one sensor for sensing movement of a cutter or cutter holder during engraving of a plurality of engraved cells in response to a source image file associated with a source image and for generating a tool path position signal in response thereto, a tool path proofing circuit for receiving said tool path position signal and for generating a pixel data signal in response thereto, and an engraver tool position reconstructed image generator analysis computer for generating an engraver tool position reconstructed image in response to said pixel data signal, said engraver tool position reconstructed image being adapted to be compared to said source image file in order to proof the accuracy of the engraving by said cutter.

In another aspect, another embodiment of the invention comprises a gravure engraver comprising a bed having a headstock and a tailstock for rotatably supporting a cylinder, a driver for rotatably driving said cylinder, an engraving head having a cutter for engraving an engraved image comprising a plurality of engraved cells in said cylinder during rotation thereof and in response to a source image file associated with a source image, a proofing system for proofing said engraved image engraved on said cylinder, said proofing system comprising at least one sensor for generating a tool path position signal in response to engraving of said source image file by said cutter, a tool path proofing circuit for receiving said tool path position signal and for generating a pixel data signal in response thereto, and a tool position image generator analysis computer for generating an engraver tool position reconstructed image in response to said pixel data signal, said engraver tool position reconstructed image being adapted to be compared to said source image file in order to proof the accuracy of the engraving by said cutter, and engraver control electronics coupled to said driver, said engraving head, said at least one sensor, said tool path proofing circuit and said tool position image generator analysis computer for controlling the operation of the gravure engraver.

In still another aspect, another embodiment of the invention comprises a gravure engraver comprising a bed having a headstock and a tailstock for rotatably supporting a cylinder, a driver for rotatably driving said cylinder, an engraving head having a cutter for engraving an engraved image comprising a plurality of engraved cells in said cylinder during rotation thereof and in response to a source image file associated with a source image, a real-time proofing system for creating a digital reconstructed image of said engraved image using pixel data for each of said plurality of cells generated in response to a position of said cutter when said cutter engraved said plurality of engraved cells in order to proof the accuracy of said engraved image engraved on said cylinder and engraver control electronics for controlling the operation of the gravure engraver.

In yet another aspect, another embodiment of the invention comprises a gravure engraver comprising a bed having a headstock and a tailstock for rotatably supporting a cylinder, a driver for rotatably driving said cylinder, an engraving head having a cutter for engraving an engraved image comprising a plurality of engraved cells in said cylinder during rotation thereof and in response to a source image file associated with a source image, a real-time proofing system for creating an engraver tool position reconstructed image in response to a sensed movement of said cutter for comparison to said source image file in order to proof an accuracy of said engraved image engraved on said cylinder, and engraver control electronics for controlling the operation of the gravure engraver.

In another aspect, another embodiment of the invention comprises a method for proofing an engraved job on a cylinder engraved by a gravure engraver, said method comprising the steps of generating a tool path position signal in response movement of a cutter while said cutter is engraving a plurality of engraved cells to provide the engraved job associated with a source image, generating a pixel data signal in response to said tool path position signal, generating an engraver tool position reconstructed image in response to said pixel data signal, and comparing said engraver tool position reconstructed image to said source image file in order to proof the accuracy of the engraving by said cutter.

In still another aspect, another embodiment of the invention comprises a method for proofing an engraved cylinder, said method comprising the steps of engraving the cylinder with an engraved job corresponding to a source image and substantially simultaneously gather tool path position signal associated with movement of a stylus used to engrave a plurality of cells for said engraved job, generating an engraver tool path position reconstructed image using said tool path position signal, comparing said engraver tool path position reconstructed image to said source image and identify differences, and determining whether any differences are within or outside acceptable tolerances in order to proof the accuracy of the engraved job engraved on the engraved cylinder.

These and other objects and advantages of the invention will be apparent from the following description, the accompanying drawings and the appended claims.

BRIEF DESCRIPTION OF THE DRAWINGS

FIG. 4A-4C is a flow chart illustrating the overall real-time tool path virtual proofing system and method;

FIG. 5 is a enlarged fragmentary view of a cutting edge of the stylus or cutter;

FIGS. 7A-7C illustrate a prior art procedure and method for determining an actual stylus profile so that an integrity of the stylus can be determined;

FIGS. 8A-8C illustrate a tool path proofing circuit and associated signals generated using the various components of the system;

FIG. 9 is a view illustrating a plurality of engraved cells and associated nesting; and FIGS. 10A-10D illustrate an engraver tool position reconstructed image generated by the system 12 and, more particularly, the tool position image generator analysis computer in response to a tool path position signal and an illustration of a successful and failed engraving example.

DETAILED DESCRIPTION OF THE PREFERRED EMBODIMENT

Figure 1:
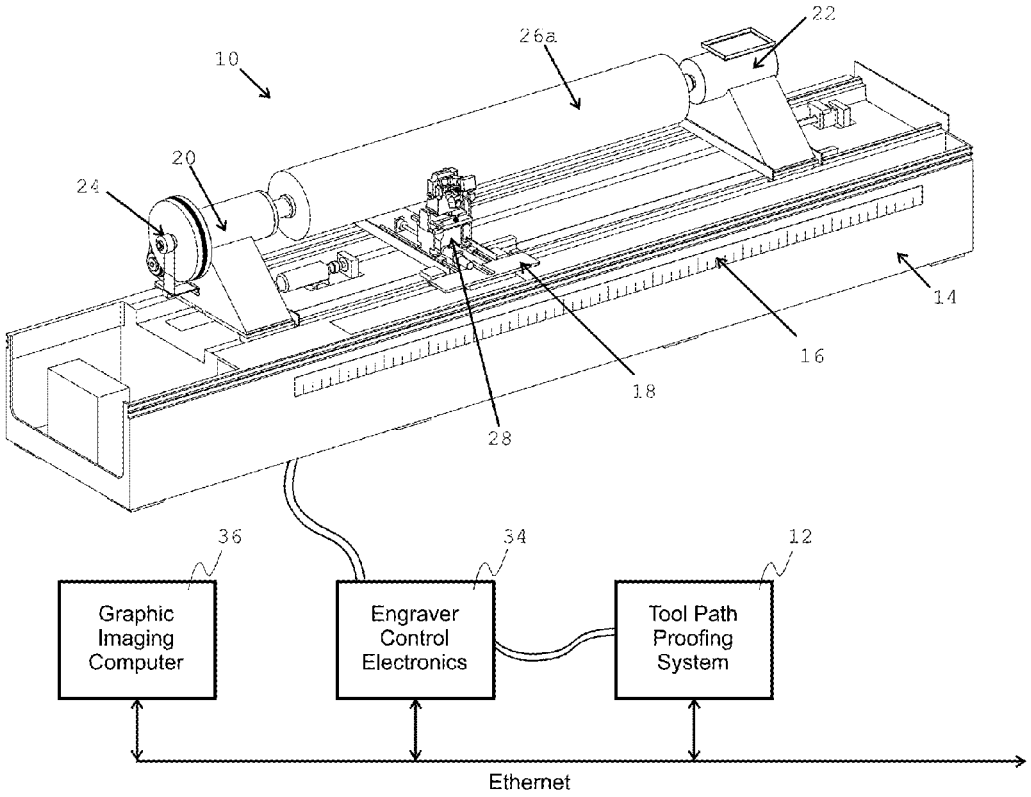
FIG. 1 is a general perspective view of an engraving system having a tool path proofing system in accordance with one embodiment of the invention.

Referring now to FIG. 1, a general perspective view of an engraver 10 having an automated proofing system 12 is shown. In the embodiment being described, the engraver 10 is a gravure engraver, but features of the proofing system may be suitable for use in any engraver incorporating at least one position sensor 48 and hence tool path position signal 50. The engraver 10 may have a surrounding slidable safety cabinet structure which is not shown for ease of illustration.

The engraver 10 comprises a base or bed 14 having a conventional bed length carriage encoder 16 and carriage 18 as shown. The engraver 10 comprises a headstock 20, tailstock 22 and rotary encoder 24 all of which are conventional and conventionally mounted on the bed 14 as shown. The engraver 10 further comprises a plurality of linear actuators or drive motors (not shown) which are capable of driving at least one or both of the headstock 20 and tailstock 22 towards and away from each other. For example, the drive motors may cause the headstock 20 and tailstock 22 to be actuated to a fully retracted position so that a cylinder 26 may be inserted there between. The headstock 20 and tailstock 22 may then be driven toward each other to rotatably support the cylinder 26 in operative relationship with an engraving head 28 mounted on the carriage 18 in a manner conventionally known. In general, the carriage 18 is driven by a drive motor or actuator (not shown) along the bed 14 while the cylinder 26 is rotated to create a helical or nested helical pattern of a plurality of engraved cells 30. FIG. 9 shows an illustrative helical pattern of a plurality of engraved cells 30 that cooperate to provide an engraved image or pattern 32 as shown.

Returning to FIG. 1, the engraver 10 further comprises conventional gravure control electronics 34 that are conventionally coupled (for example, via an Ethernet) to a graphic imaging computer 36. In a manner conventionally known, an artist uses the graphic imaging computer 36 to create a full color image of the image or text that is desired to be printed on a substrate (not shown), such as a paper or other textile substrate. For ease of understanding, the composite source image is referred to hereinafter as a composite source image file. One illustrative source image file may be, for example, the image or artwork that appears on a product packaging, such as a cereal box.

The graphic imaging computer 36 of FIG. 1 performs a conventional raster image processing (RIPped) function which separates the composite source image file into yellow (Y), magenta (M), cyan (C) and black (K) or YMCK. The RIPped function generated by the graphic imaging computer 36 also creates the appropriate size bitmap source image file 38, illustrated in FIGS. 10C and 10D, for each of the colors, thereby resulting in a Y bitmap source image file, M bitmap source image file, C bitmap source image file and K bitmap source image file. Note that the source image file is a bitmap that the graphic imaging computer creates the layout of the image. Further features of the use of the YMCK bitmap source image files will be described later herein.

The engraver 10 further comprises the tool path proofing system 12 and a tool position image generator and analysis computer whose function and operation will be described later herein. The engraving bed 14, encoder 16, carriage 18, headstock 20, tailstock 22, rotary encoder 24 and engraving head 28 may comprise features or components of the Spectrum Engraver available from Ohio Gravure Technologies, Inc. of Dayton, Ohio.

In general, the engraver control electronics 34 controls the operation of the engraver 10 and controls all drive motors in order to perform the desired engraving of the source image file. In one illustrative embodiment, note that the engraver control electronics 34 receive encoder signals from the rotary encoder 24 which are necessary to perform the engraving and to provide a signal for each revolution of the cylinder 26 for use by the tool path proofing system 12.

Figure 2:
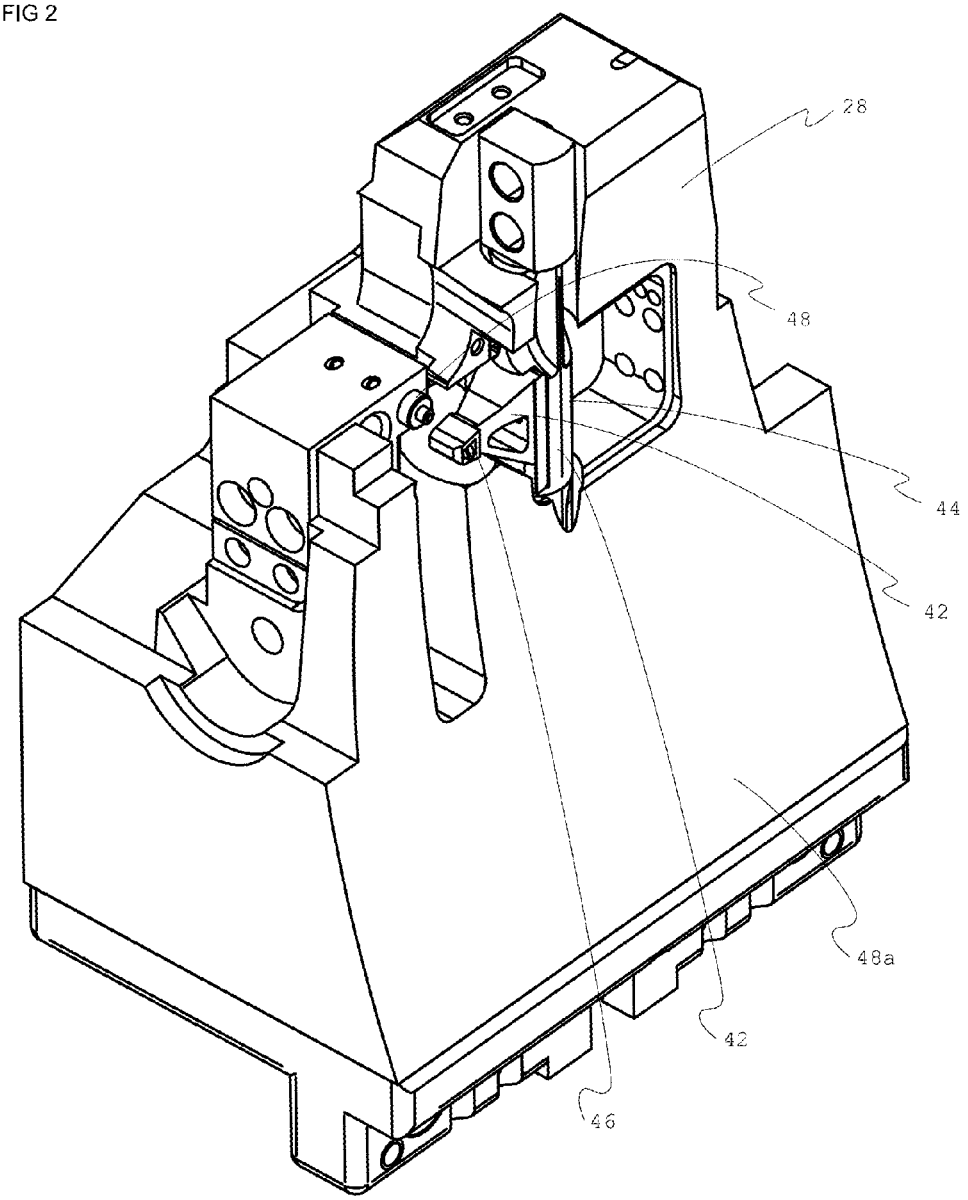
FIG. 2 is an enlarged perspective view showing the engraving head, a cutting stylus or cutter and at least one sensor positioned in operative relationship to the stylus or cutter.

Referring now to FIG. 2, an enlarged perspective view of the engraving head 28 is shown. In the embodiment being described, the engraving head 28 is a Vision 3 Engrave Head available from Ohio Gravure Technologies, Inc. of Dayton, Ohio. In the illustration being described, the engraving head 28 comprises a cutting stylus arm 42, which is conventionally mounted to a driven shaft 44, that supports a cutter, cutting stylus or tool 46 in a manner conventionally known. The engraving head 28 also comprises at least one position sensor 48 which in the illustration being described is an inductive sensor that generates a tool path position signal 50 (FIGS. 6 and 8B) in response to movement of the cutter, cutting stylus or tool 46 or cutting stylus arm 42. Note in FIG. 3 that the at least one position sensor 48 is positioned in proximity to the cutter, cutting stylus or tool 46 and, using an inductive field (or comparable position measurement technique), generates the tool path position signal 50 (FIGS. 6 and 8B) in response to the motion of the cutting stylus arm 42. Information may also be provided regarding the cutter, cutting stylus or tool 46 as it is profiled before and after cutting to ensure integrity. In this manner and as described in more detail later herein, the engraver 10 uses an actual, real-time signal that is created directly in response to the actual motion and movement of the cutting stylus arm 42 or the cutter, cutting stylus or tool 46. In a manner described later herein, this signal is used to generate an engraver tool position reconstructed image 90 (illustrated in FIGS. 10C and 10D) of the plurality of engraved cells 30 and that image is then compared to the source image in order to proof the engraving on the cylinder 26.

In a manner conventionally known, the cylinder 26 (FIG. 1) rotation is positionally controlled via position signals from the rotary encoder 24. The rotary encoder 24 generates rotary encoder signals which include a one-rev signal 52 (FIGS. 8B and 10B) for each complete 360° revolution of the cylinder 26. In a manner also conventionally known, the engraving head 28 is mounted on the carriage 18 and is driven substantially parallel to an axis of the cylinder 26 while the stylus arm 42 is driven by an electro-magnetic motor (not shown) or other acutating device within the engraving head housing 48*a* (FIG. 2), thereby engraving the nested pattern 32 of the plurality of engraved cells 30 illustrated in FIG. 9.

An important feature of the embodiment being described is that it is adapted to utilize the tool path position signal 50 generated by the at least one position sensor 48. The tool path position signal 50 is in proportion to the movement of the stylus arm 42 and cutter, cutting stylus or tool 46 positions. The inventors have found that the tool path position signal 50 accurately describes the actual gravure cell, such as cell 30 in FIG. 9, created by the cutter, cutting stylus or tool 46.

Figure 3:
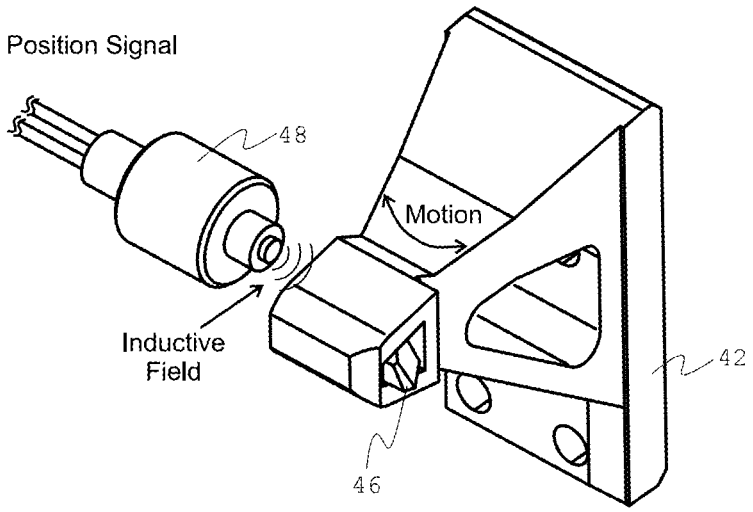
FIG. 3 is fragmentary view and enlarged view of the cutting stylus arm and stylus or cutter and the at least one sensor.

To understand the relationship between the tool path position signal and the plurality of engraved cells 30 that make up the nested pattern 32, an enlarged view of the stylus arm 42, cutter, cutting stylus or tool 46 and the at least one position sensor 48 are shown in FIGS. 2 and 3. In the illustration being described and as mentioned earlier, the at least one position sensor 48 is a conventional inductive type of position sensor, or other sensing technology, such as but not limited to optical sensing, whose analog position signal 50 is proportional to the motion of the stylus arm 42 or motion of the cutter, cutting stylus or tool 46. Once the tool path position signal 50 is generated by the at least one position sensor 48, the tool path position signal 50 can be used to accurately describe the plurality of cells 30 and their associated density, which is then used to proof the engraving job engraved on the cylinder 26 as described herein. The at least one position sensor 48 generates the tool path position signal 50 that is proportional to the movement of at least one of the stylus arm 42 or cutter, cutting stylus or tool 46. In the illustration being described, the at least one position sensor 48 should preferably have a bandwidth above 20 kilohertz and a dynamic swing range of at least 100 microns with an accuracy of 1% or less over this range.

Figure 6:
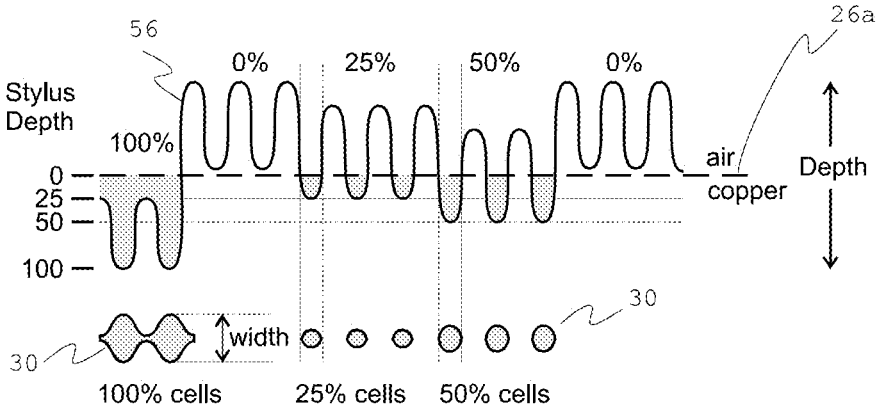
FIG. 6 is a view illustrating an input signal associated with a source image file created by the at least one sensor.

The cutter, cutting stylus or tool 46 and its relation between the cutting stylus depth and the corresponding gravure cell 30 width will now be illustrated relative to FIGS. 5 and 6. Again, it is important to understand that the tool path position signal 50, which is illustrated in FIG. 6, describes movement of the cutter, cutting stylus or tool 46 and directly corresponds to a depth D of each of the plurality of engraved cells 30. The tool path position signal 50 is used to translate or describe a measurement of the cell density in a manner which will now be described.

In FIG. 5, the cutter, cutting stylus or tool 46 is shown having the cutting edge 46*a*. The relationship between the cutter, cutting stylus or tool 46 depth D and width W is defined by the equation:

$$W=2D\tan(\theta/2)$$

It should be noted that other cutting stylus shapes exist, although they are very uncommon, which are not a simple fixed angle, rather it could be flat tipped, spherical, elliptical or some other polynomial shape.

The bottom portion of FIG. 6 illustrates the various illustrative engraved cells 30 corresponding to the tool path position signal 50. Note that the dashed line in FIG. 6 represents a surface 26*a* of the cylinder 26, with those portions of the tool path position signal 50 falling below the line indicating engraved areas of a given density and those that do not traverse the line indicated no engraving or a density of 0%. In general, a depth of a cell, as represented by the tool path position signal 50, varies within the engraved cylinder 26 to produce a variation of printing densities or tones that are necessary to reproduce the desired source image file mentioned earlier. The graphical imaging computer 40 produces a corresponding 8-bit pixel data signal 56 corresponding to the source image file and that signal 56 has a density between 0 and 255 ($2^8$). In the example shown in FIG. 6, various densities of cells, such as 25% and 50% density cells, are shown for illustration purposes. FIG. 6 thereby represents the pixel data signal 56 between 100% (255 or maximum density) and 0% (0% density) for illustration purposes. The engraver control electronics 34 controls the engraver 10 and the engraving head 28 and drives the engraving head shaft 44 which in turn drives the stylus arm 42 which drives the cutter, cutting stylus or tool 46 to engrave the appropriate density cell from 0-100% (or 0-255) depth in response to the pixel data signal 56.

It has been mentioned that a measure of the cutter, cutting stylus or tool 46 or stylus arm 42 position and subsequent generation of the tool path position signal 50 (FIGS. 8B and 8C) represents the gravure cells 30, which are illustrated in FIGS. 6 and 9 through the equation mentioned earlier herein and illustrated in FIG. 5. However, this is only true if the cutting edge 46*a* of the cutter, cutting stylus or tool 46 and the associated stylus cutting tool angle θ, illustrated in FIG. 5, is known and remains substantially consistent throughout the engraving of the gravure cells 30 in the cylinder surface 26*a* of the cylinder 26. In one embodiment, an integrity of the real-time virtual proofing system in insured by measuring the stylus cutting tool angle θ both before and immediately after engraving the gravure cylinder 26. Ultimately, and as described later herein, this is accomplished by performing a test cut prior to engraving and a test cut after engraving and creating an associated stylus profile 66 (FIG. 7C). FIG. 7C shows the profile of FIG. 7A (optical) and 7B (position sensor) measurements. The profiles 66 from each test cut are then compared to ascertain the integrity of the cutter, cutting stylus or tool 46 and, for example, whether or not it is within tolerances or is broken, damaged or the like. In general, a typical cutter, cutting stylus or tool 46 will last approximately 100 or more cylinders 26 engraved, so while it is oftentimes desired to perform such integrity verification, it is not always necessary to do so, especially when a minimally worn cutter, cutting stylus or tool 46 is used. The cutting tool stylus profiling processes will now be described relative to FIGS. 7A and 7B.

FIG. 7A shows a test cut cell depth signal created by the engraver control electronics 34 (FIG. 1) and which is sent to the engraving head 28 in a manner conventionally known. FIG. 7A shows a test cut signal 68 generated by the engraver control electronics 34. Thus, it should be appreciated that the control electronics 34 drives the engraving head 28 which results in the test cut signal 68 on the position signal. Note that test cut signal 68 and the tool position signal 50 are sourced the same but with a different drive signal. Note in FIG. 7B, a resultant cell width versus time is illustrated. A sequence of video tone signals (i.e., equivalent to the 8-bit image density signal produced within the graphic imaging computer 36 and associated with the source image file produces the depth signal 68 in a defined sequence from largest or maximum density to zero density, as illustrated in FIGS. 7A and 7B. In the illustration being described, the engraving head 28 drives the cutter, cutting stylus or tool 46 in response to the video tone signal from the graphical imaging computer 36 to a depth of 100% or 255/255. After approximately 2 ms the drive signal 68 will shift to 95% or 242/255 binary with a result length increase of approximately 2 mm with any drag not being critical to the profile measurement provided herein. The engraving sequence illustrated in FIGS. 7A and 7B continues in 5% decrements down to 0% or 0/255. The engraving sequences generated by the signal 68 will ultimately create a piece-wedge of coincidentally, approximately 35-50 mm.

Once the test cut integrity engraving is performed in response to the test cut signal 68 (FIG. 7A), the stylus cutting tool angle θ of the cutting edge 46*a* of the cutter, cutting stylus or tool 46 can then be determined in a manner conventionally known. The width W of the cut is measured optically. The depth D is measured via the position sensor 48. This process is done, for example, 20 times and the points are plotted and a least squares straight line fit is performed. The angle of the line will represent the stylus angle. For example, when a 120 degree stylus is used, 0.289 microns of depth occurs for every one micron of width. For example, the stylus cutting tool angle θ can be determined by simultaneously measuring both the depth D and width W while engraving the cylinder 26 and applying the formula mentioned earlier and shown in FIG. 5. The stylus cutting tool angle θ is determined by properly measuring the stylus cutting depth D of FIG. 7A and the width W shown in FIG. 7B. The cell and associated width W can be optically measured through various conventional image processing techniques such as shown in U.S. Pat. Nos. 5,737,090; 5,492,057; 5,440,398; 5,438,422; 5,424,845; 5,663,802; 5,894,354; 5,671,063; 5,831,746; 6,614,558; and 6,348,979, all of which are incorporated herein by reference and made a part hereof. The depth D is measure by digitizing signal 68 which is routed, or equivalent to, signal 50 of FIG. 8A, and converted by Analog-to-Digital converter 80 and processed/calculated by computer 102 of FIG. 8A.

To improve the accuracy of calculating the average stylus cutting tool angle θ, the cutter, cutting stylus or tool 46 can be driven to multiple depths as illustrated in FIG. 7A and correspondingly measuring multiple widths W as illustrated in FIG. 7B. The sequence of depths D and widths W can then be averaged to produce an approximate stylus cutting tool angle θ. It should be understood and as is conventionally known, the stylus cutting tool angle θ can actually vary as a function of depth as described in U.S. Pat. Nos. 5,825,503; 5,440,398; 5,438,422 and 5,424,845, all of which are incorporated herein by reference and made a part hereof.

As mentioned earlier, it is the intention of the two test cuts to confirm that the stylus cutting tool angle θ is within tolerances and that the cutter, cutting stylus or tool 46 is not broken or damaged and is generally consistent prior to cutting the engraving job and after cutting the engraving job to confirm, for example, that the cutter, cutting stylus or tool 46 did not break or chip excessively while engraving the engraving job. This is desired to ensure the integrity that the measuring of the position of the stylus arm 42 and the associated signal 50 sensed by the at least one position sensor 48 will accurately and reliably predict the corresponding cell 30, or cell width W while engraving the entire engraving job on the cylinder 26. Again, it should be understood that a volume of each cell 30, as defined by the depth D and width W of a cell, will determine the print density and image reproduction quality. As mentioned earlier herein, it is one advantageous feature of the proofing system described herein to reliably predict the gravure cell depths D, the widths W and density or volume for each cell 30 on the gravure cylinder 26. In order to perform this measurement and subsequent proofing of the engraved cylinder 26, the tool path proofing system 12, which will now be described.

Figure 8B:
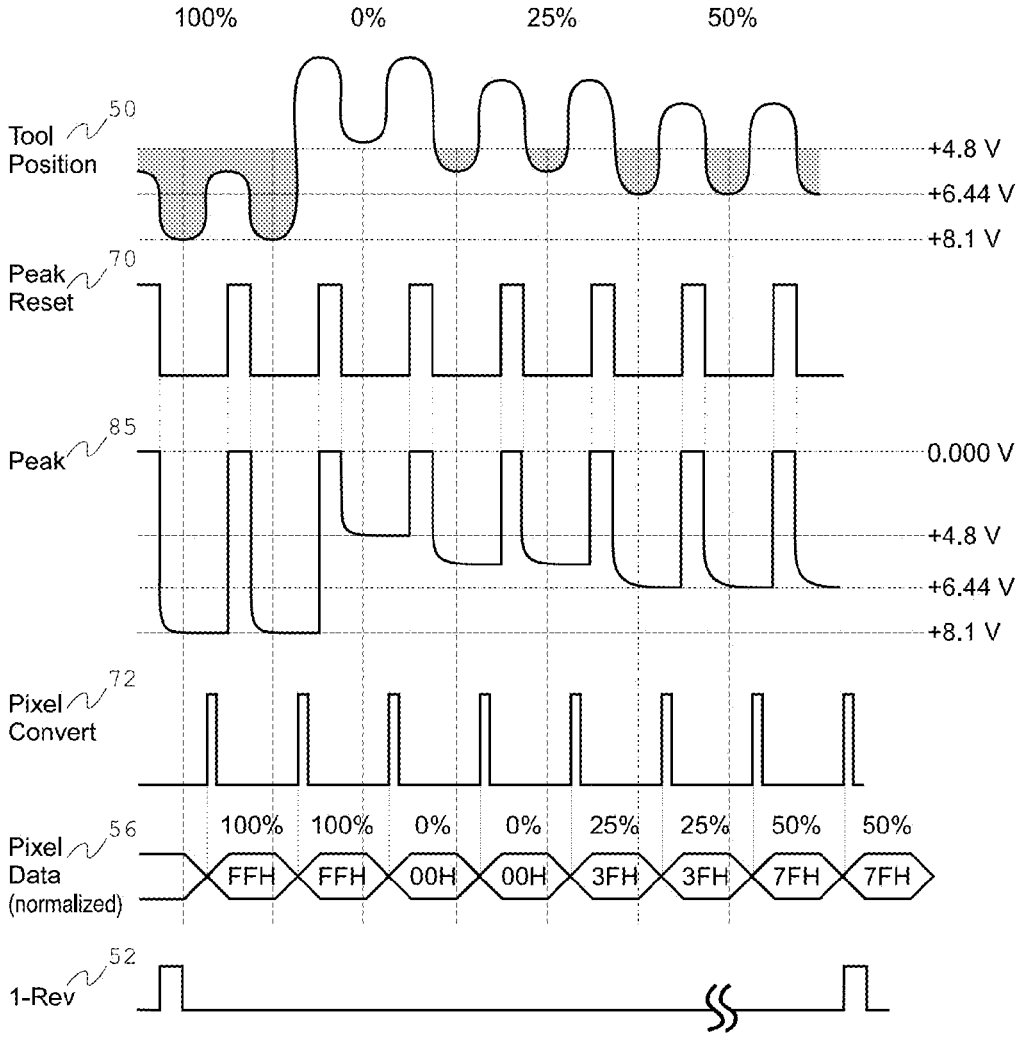
Figure 8C:
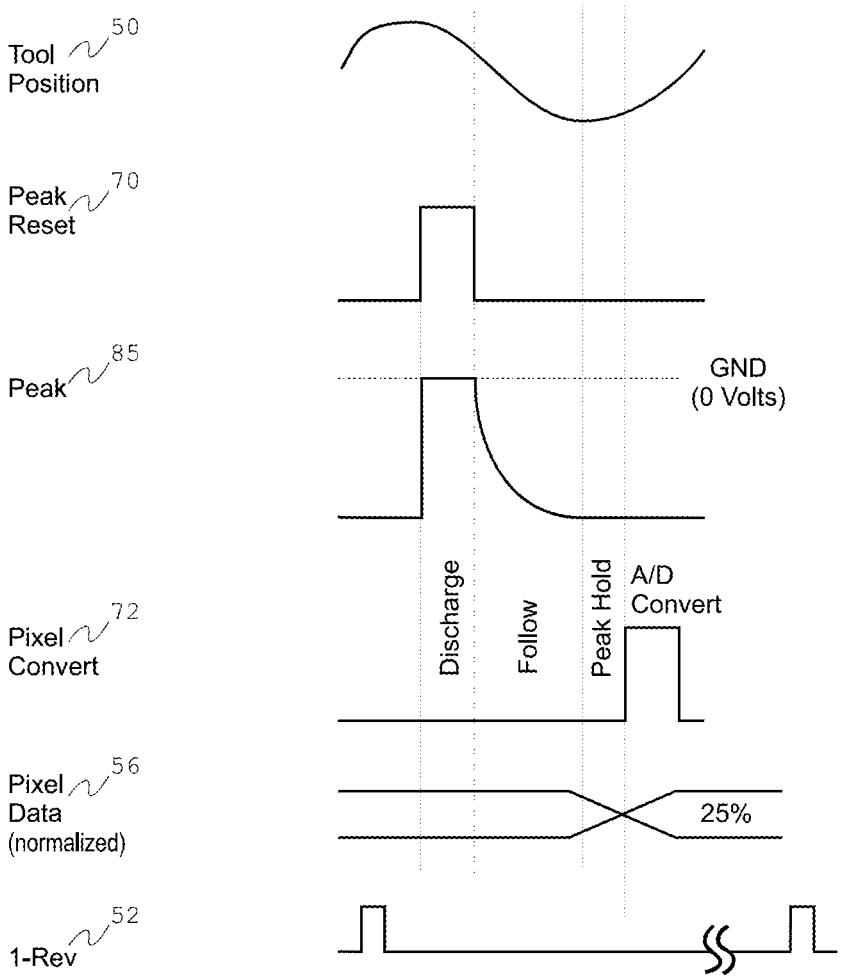

Referring now to FIGS. 8A-8C, the tool path proofing system 12 is adapted for proofing an image engraved on the cylinder surface 26*a* of the cylinder 26. For ease of illustration, the associated waveforms generated using the tool path proofing system 12 in FIG. 8A are illustrated in FIGS. 8B and 8C which should preferably be studied together. The tool path proofing system 12 is adapted to receive the tool path position signal 50 from the at least one position sensor 48 (FIG. 8A) and to utilize this signal 50 to measure and ultimately determine a density for each engraved cell 30. Recall that the tool path position signal 50 is used to represent a depth of the cutter, cutting stylus or tool 46 which is then used to determine a density for each of the cells 30 using the tool path position signal 50. As mentioned earlier, each AC cycle represents one gravure cell 30 or pixel value from 0-255 as mentioned earlier.

In general, it is desired to digitize the AC amplitude peak associated with the AC cycle (i.e., with each cell 30 or pixel).

In the illustration being described, the engraver control electronics 34 (FIG. 1) knows the timing of each AC, or cell 30, cycle. Accordingly, it creates a peak reset signal 70 (FIG. 8B), a pixel convert signal 72, and the one rev signal 52 mentioned earlier, all of which are used to aid the analog-to-digital process during which the tool path position signal 50 is converted to the pixel data signal 56 illustrated in FIG. 8B. It should be understood that the timing signals generated in the engraver control electronics 34 ensure that the capacitor is reset at the minimum and sample as the maximum occurs.

To accomplish this conversion, FIG. 8A illustrates a peak detection circuit 74 comprising an operational amplifier 78, an analog-to-digital converter 80, diode 82, capacitor 84 and switch 88 arranged and configured as illustrated in FIG. 8A. The switch 88 is used to create a zero charge condition at a start of each engraved cell 30 which may be considered to be or have a single associated pixel value. Once the switch 88 is open, the voltage of the operational amplifier 78 begins to track the tool path position signal 50 resulting in a peak signal 85 (FIG. 8B) on line 86 and which becomes an input for channel two of the analog-to-digital converter 80. Note that the peak signal 85 cannot drop in voltage until a peak reset associated with the peak reset signal 70 (FIG. 8B) occurs. While the peak signal 85 is in a generally stable or constant voltage or current state since the peak tool position signal 50 occurred, a pixel convert signal 72 from the engraver control electronics 34 will pulse to initiate a digitization process in the analog-to-digital converter 80, thereby resulting in a conversion of the peak signal 85 to a digital pixel data value which is illustrated in the pixel data signal 56.

Advantageously, this results in each cell 30 being represented by a single digitized pixel value from 0-100% and ultimately normalized to an 8-bit value from an output of the analog-to-digital converter 80 between 0 and 255 corresponding to the source image.

Thus, it should be understood that the peak detect circuit 74 generates a peak voltage signal that tracks the tool path position signal 50 generated by the at least one position sensor 48 and when the peak signal 85 is at a generally constant voltage or current, the peak detect circuit 74 digitizes the peak voltage signal into at least one digitized pixel value for each of the plurality of engraved cells 30 that make up the engraved pattern 32. The pixel data signal 56 comprises, in a preferred embodiment, at least one digitized pixel value for each cell 30. In a manner described later herein, the pixel data signal 56 is used to create the engraver tool position reconstructed image 90 (illustrated in FIGS. 10C and 10D) which is used for proofing the engraving on the cylinder 26 as described herein.

Returning to FIGS. 6 and 8B, it should be understood that the pixel data signal 56 is created by an 8-bit source image video signal (not shown) associated with the source image file from the graphic image computer 36 and that rides on an AC signal, for example, the pixel data signal 56 in FIG. 6, of around 8100 hertz, as in conventionally known. That signal is the engraving signal associated with the source image file that is used to engrave the pattern 32 of cells 30. As the pattern 32 of cells 30 is engraved, the at least one position sensor 48 senses the movement of the cutter, cutting stylus or tool 46 or of the movement of the stylus arm 42 which directly corresponds and is related to the movement of the cutter, cutting stylus or tool 46 to create the composite tool path position signal 50 (FIG. 8B).

The analog-to-digital converter 80 (FIG. 8A) is preferably 12-bits or higher to have a resolution to accurately resolve the 8-bit tool path position signal 50. The reference voltage on the analog-to-digital converter 80 in the illustration being described is +10 volts so it can convert input signals from 0-+10 volts. In order to convert the tool path conversion signal 50 voltage levels into the engraver stylus position reconstructed image 90 (illustrated in FIGS. 10C and 10D) for use in comparing to the source image bitmap, a maximum voltage and minimum voltage swings and their effect on the digital pixel data value and the pixel data signal 56. Stated another way, it is desired to associate a hundred percent voltage level and zero percent voltage level of the tool position path signal 50 with an associated actual density value so that a correlation of the density values for each of the plurality of engraved cells 30 that make up the pixel data signal 56 is accurate. The goal is to normalize the signal by the knowing the maximum and minimum it will swing and set the voltage associated with the minimum to 0% and the maximum to 100%. Accordingly, the values used during a test cut, such as the test cuts mentioned earlier herein, for a hundred percent or zero percent cell 30 are engraved during the test cut and the associated density or pixel data value for an engraved test cut cell 30 is measured. A sample calculation associated with the normalized pixel data value is as follows:

$$\text{ADC_Pixel}_{min}=4.8\text{V}\rightarrow(4.8/10)*(2^{12}-1)$$
$$=1965.6\rightarrow 7AEH(U3,\text{12-bit ADC output})$$

$$\text{ADC_Pixel}_{max}=8.1\text{V}\rightarrow(8.1/10)*(2^{12}-1)$$
$$=3317.0\rightarrow CF5H(U3,\text{12-bit ADC output})$$

$$\text{Pixel_Data},30=((\text{ADC_Pixel}_{sample}-\text{ADC_Pixel}_{min})/(\text{ADC_Pixel}_{max}-\text{ADC_Pixel}_{min}))*(2^{8}-1)$$

It should be understood that the previous calculation used the second channel (CH2) input on the analog-to-digital converter 80 associated with the peak detection circuit 74. However, it should be understood that the first channel (CH1) input is also possible if one wanted to digitize the entire tool path position signal 50 with a high speed analog-to-digital converter, such as the first channel of the analog-to-digital converter 80 and perform signal processing techniques to extract the desired digital pixel information within the computer 102. Note that the processing can be done within the computer 102 to represent more than a single value for the entire pixel.

The real-time virtual tool path proofing system 12 is adapted to reconstruct the engraver tool position reconstructed image 90 (illustrated in FIGS. 10C and 10D) mentioned earlier herein. The engraver tool position reconstructed image 90 is then compared to the original bitmap source image file 38 (illustrated in FIGS. 10C and 10D) provided by the graphic imaging computer 36. With this comparison, the accuracy of the engraved cells 30 and of the pattern 32 can be proofed, thereby facilitating bypassing traditional proofing methods such as ink and substrate proofing, creating hard copy proof and other traditional proofing techniques.

In order to accurately compare the dimensional information associated with the pixel data signal 56 for each of the cells 30, it is necessary to know the dimensional information describing the pixel or cell size and screen of the engraving image. In the illustration being described, the graphic imaging computer 36, engraver control electronics 34 and, in turn, the tool path proofing system 12 all know the cell and pixel geometry associated with the original source image file parameters for the defined engraved job prior to engraving the job. For ease of understanding, a conventional illustration of the nested cells 30 for an engraving job is illustrated in FIG. 9. Note that each column represents one revolution of the cylinder 26 with the cell height, cell width, wall width, screen ruling and screen angle θ all being illustrated for ease of reference and understanding.

To perform proofing, the real-time tool path proofing system 12 will reconstruct the engraver tool position reconstructed image 90 using the pixel data signal 56, pixel height (PH) and pixel width (PW). For ease of illustrating, a sample engraver tool position reconstructed image 90 will now be illustrated relative to FIGS. 10B and 10C. First, the cells are depicted in a bitmap table, such as the bitmap table 100 shown in FIG. 10A. Each full block in the bitmap table 100 represents a cell having a density value that will be populated using the pixel data signal 56 (FIG. 8B) mentioned earlier. Note that the columns represent each revolution (1-N) of the cylinder 26 and the rows represent the particular cells from 1-M. In the illustration being described, the engraver 10 is a gravure engraver that generates a nested engraved pattern along the surface 26*a* of the cylinder 26, as illustrated in FIG. 9. One complexity related to gravure engraving is that the gravure engraved image is formed from the nesting of the cells 30 as illustrated in FIG. 9 and as is conventionally known. This means that the odd and even revolutions are positioned or offset by a half of cell or 180 degrees as illustrated in FIG. 9B which shows the pixel data associated with an odd revolution and even revolutions and mapped back to the engraver stylus position reconstructed image 90 of FIG. 10A.

The tool path proofing system 12 comprises the tool position image generator analysis computer 102 (FIG. 8A) that receives the pixel data signal 56 and populates the bitmap table 100 to provide a populated engraver stylus position reconstructed image 90 or bitmap illustrated at the top of FIGS. 10C and 10D. For ease of understanding, note that the density values for the first rows 1-8 are numerically represented to the left of the bitmap table 100 in the left hand column of FIGS. 10C and 10D. Thus, for example, the first cell in the first rev is a hundred percent density, the third cell is a zero percent density cell and the eighth cell is a fifty percent density cell in the illustration.

Once the engraver tool position reconstructed image 90 is constructed, it can be compared against the engraver source image file or bitmap source image file 38 which was originally desired to be engraved. The tool position image generator analysis computer 102 may then reconstruct a source difference image or proofing result by overlaying or comparing the engraver tool position reconstructed image 90 to the engraver source image or bitmap source image file 38 and creating a difference image or proofing result report 108 (illustrated in FIGS. 10C and 10D) in response thereto. The difference image or proofing result report 108 may be displayed on a display for an operator to view and inspect or may be printed into a report form as illustrated at the bottom of FIGS. 10C and 10D or an engraving alarm may be generated if differences exceed predetermined metrics or predetermined tolerance levels. In this regard, note FIG. 10C illustrates an engraving job where there are no differences. Note that the engraver tool position reconstructed image 90, when compared to the engraver source image or bitmap source image file 38, shows difference image or proofing result report 108 showing no differences between the two.

In contrast, FIG. 10D illustrates a problem area 110 resulting from the proofing comparison. In this example, note that the engraver source image or bitmap source image file 38 called for engraving of cells in rows 3 and 4 during revs 5-7, whereas the resultant engraver tool position reconstructed image 90 illustrates no such engraving (i.e., zero percent density cells). Accordingly, the difference image or proofing result report 108 illustrates or highlights the problem area 110 showing the missing high density pixels representing non-engraved areas.

Advantageously, the operator may use this difference image or proofing result report 108 to proof the engraving performed by the engraver 10. This facilitates reducing or eliminating the need for traditional proofing of the type described in the Background of the Invention.

It should be noted that the reconstructed image 90 and the difference image 108 can be updated and displayed by the tool position image generator and analysis computer 102 in real-time while the cylinder 26 is being engraved as a reference for the engraver operator allowing the operator to terminate the engraving if a problem, such as 110 is detected during engraving and thus saving time.

It should also be understood that the tool path proofing system 12 may generate an alarm or other notice or indicia to notify the operator of the proofing results and/or differences between the engraved image and the source image.

Figure 4B:
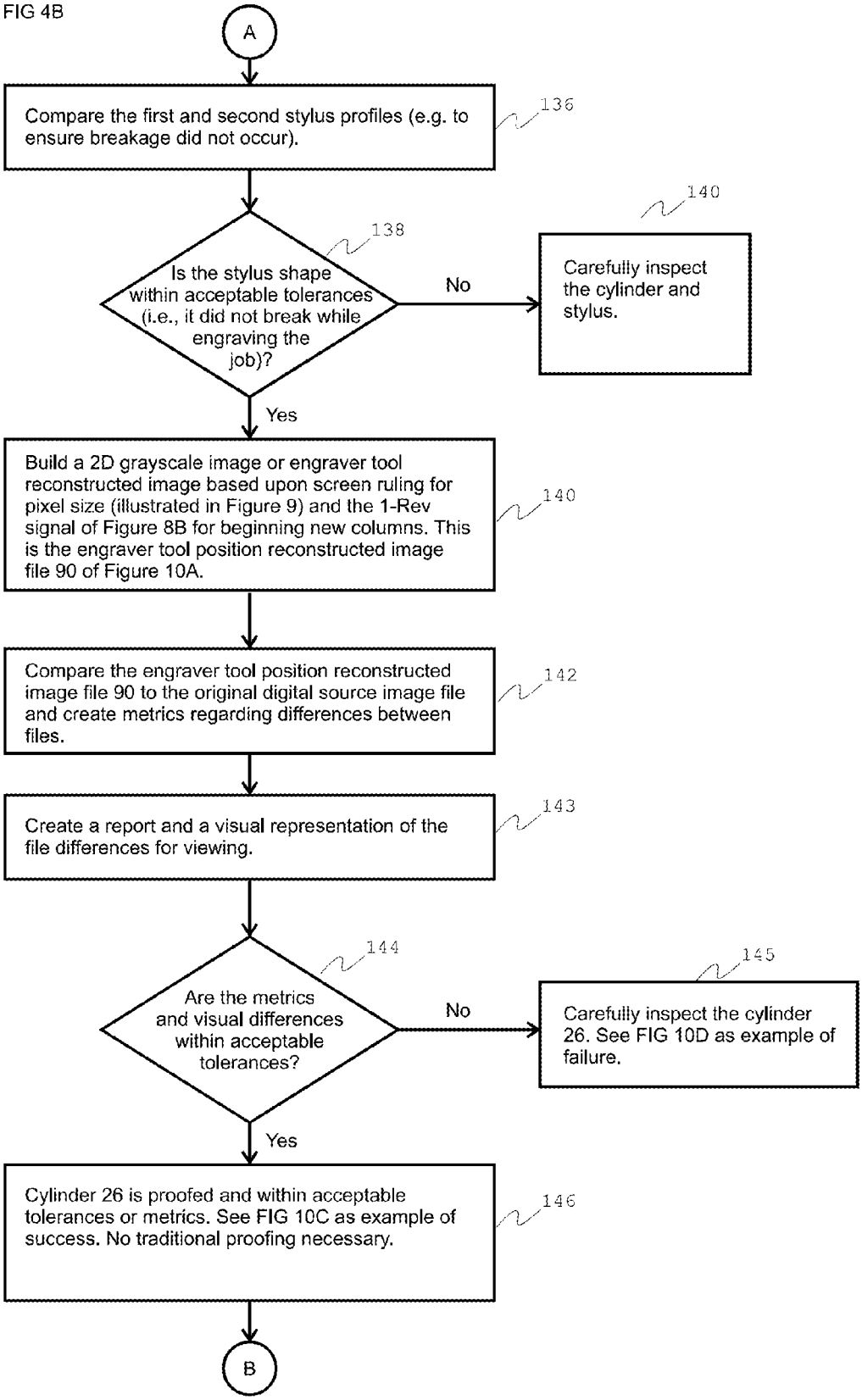
Figure 4C:
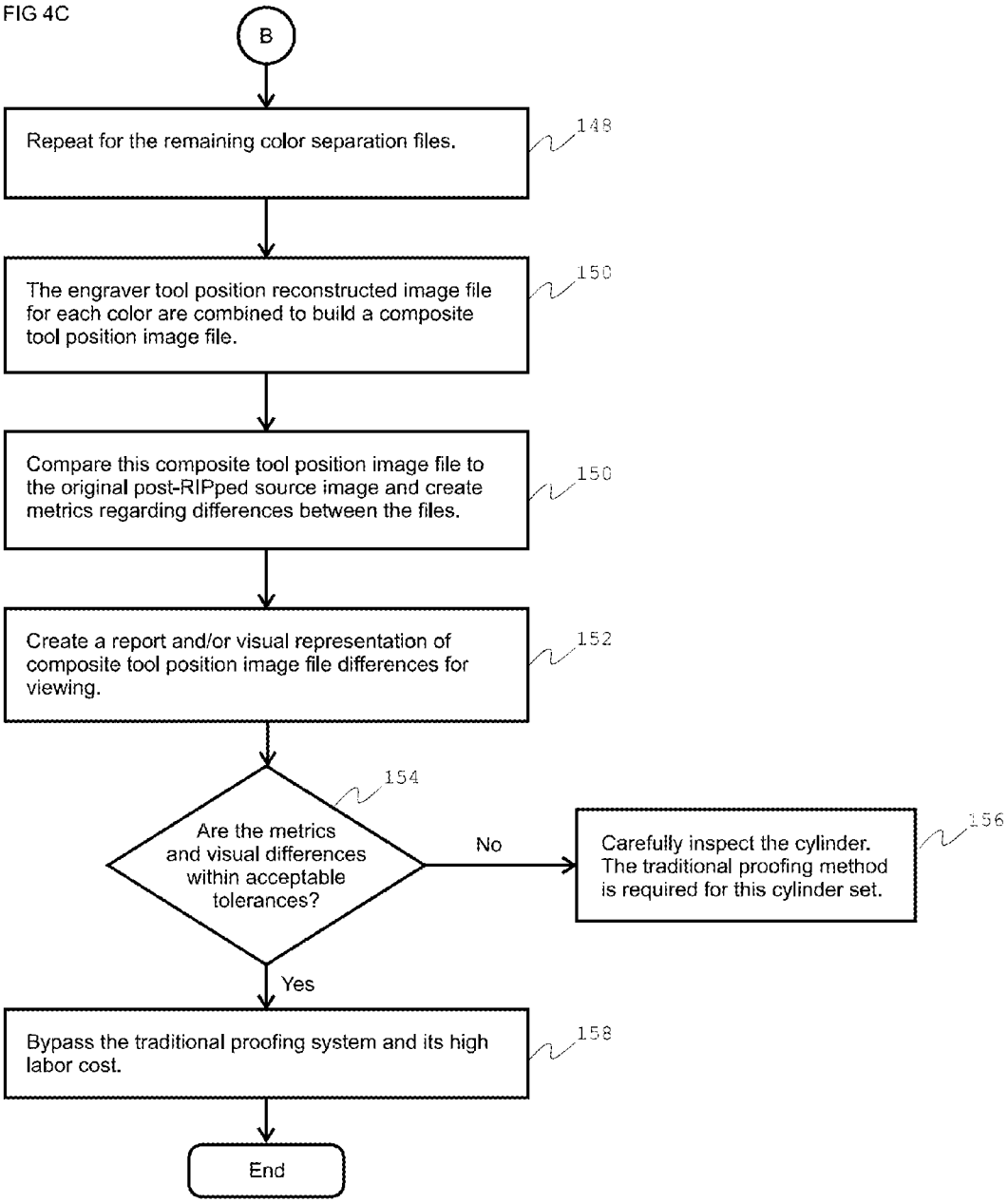

An overall real-time tool path virtual proofing system process and procedure will now be described relative to FIGS. 4A-4C. The procedure begins at block 120 where the artist creates a full color image of what must be printed on the substrate. This is the composite source image file mentioned earlier herein as this image is the image that is desired to be printed on the substrate, such as on a cereal box.

At block 122 the graphic imaging computer 36 (FIG. 1) performs the raster image processing RIP function which separates the composite source image file into individual YMCK colors. The RIP also creates the appropriate sized bitmap source file for each color (Y bitmap source file, M bitmap source file, C, bitmap source file and K bitmap source file). The procedure continues to block 124 where the engraving operator downloads the desired color separation file (for example, Y bitmap source file) to be engraved by the engraving system 10. The routine continues to block 126 where the engraver operator implements the following for the chosen color bitmap source image file. The operator performs a stylus profile test cut prior to engraving the cylinder 26 as part of the test cut process and as described earlier herein relative to FIGS. 7A and 7B. At decision block 128 it is determined whether or not the stylus shape is within acceptable tolerances (for example, is the stylus chipped or broken, etc.). If it is not within acceptable tolerances, the cutter, cutting stylus or tool 46 is replaced (block 130) and the routine loops back to block 126 as shown.

If the decision at decision block 128 is affirmative then the operator engraves the job and simultaneously gathers the stylus tool path position data mentioned earlier herein using the tool path proofing system 12 and circuit 74 shown in FIG. 8A. The routine continues to block 134 where a second stylus profile test cut or check is performed after the engraving of the cylinder 26 in the manner described herein relative to FIGS. 7A and 7B. The routine continues to block 136 (FIG. 4B) wherein a comparison of the first and second stylus profiles resulting from the first and second test cuts, respectively, are checked to confirm the integrity of the cutter, cutting stylus or tool 46 and, for example, to confirm that the cutter, cutting stylus or tool 46 breakage did not occur.

The routine continues to decision block 138 wherein it is determined whether the shape of the cutter, cutting stylus or tool 46 is within acceptable tolerances and if it is not then the operator carefully inspects the cylinder 26 for errors. If the decision at decision at decision block 138 is affirmative, then the routine proceeds to block 140 and the two-dimensional grey scale image or engraver tool position reconstructed image 90 is generated using and based upon the screen ruling for the pixel size (illustrated in FIG. 9) and the one-rev signal of FIG. 8B for beginning new columns. This is the engraver tool position reconstructed image file 90 illustrated in FIGS. 10A and 10C-10D.

The routine continues to block 142 wherein a comparison of the engraver tool position reconstructed image file 90 is compared to the original source image file and metrics are created regarding the differences between the files. The metrics will be created to make the comparison quantitative. As noted below, in one embodiment the metrics that could be used are a histogram of the difference magnitude (how often do certain amplitudes of error occur), average error, standard deviation, maximum pixel density difference, etc. One benefit will be to evaluate the quality of the engraving head 24 (i.e., the ability to look at things like head drift, ring, hysteresis, etc.) As mentioned earlier herein, the routine continues to block 143 wherein the difference image 108 or visual representation of the file differences are created, printed or displayed for viewing by the operator. The routine proceeds to decision block 144 wherein it is determined whether or not the metrics and visual differences are within acceptable tolerances and if they are not then the operator carefully inspects the cylinder 26 as illustrated at block 145. If the decision at decision block 144 is affirmative then the routine proceeds to block 146 wherein it is confirmed that the cylinder 26 is proofed and is within acceptable tolerances or metrics. Note that at this block 146, it should be understood that no traditional proofing of the type described earlier herein in the Background of the Invention is necessary. FIG. 10C is an example of such success. FIG. 10D illustrates an example of a failure.

Thereafter, the routine proceeds to block 148 (FIG. 4C) wherein the procedure is repeated for each remaining color separation file by repeating the steps shown at blocks 124-146.

Thereafter, the color mix of the engraver tool position reconstructed image file for each color is combined to build a composite tool position image file (block 150). At block 152, the composite tool position image file or engraver tool position reconstructed image 90 is compared to the original post-RIPped source image file artwork and differences between the files are noted in a manner similar to that shown and described earlier herein relative to FIGS. 10C and 10D. Again, metrics or tolerances are created to identify differences that are not within acceptable tolerances. At block 152 a report, similar to the proofing result report 108 in FIGS. 10C and 10D, is created or displayed to provide a visual representation of the composite tool position image file. At decision block 154 it is determined whether or not the metrics and visual differences are with acceptable tolerances and if they are not then the operator inspects one or more of the cylinders 26 that make up the engrave job. In the illustration being described, the "metrics" may a histogram of the difference magnitude (how often do certain amplitudes of error occur), average error, standard deviation, maximum pixel density difference, etc. As stated above, another benefit will be the ability to evaluate the quality of the engraving head 24 (i.e., the ability to look at things like head drift, ring, hysteresis, etc.).

At block 156 that is the composite tool position image file is not within acceptable tolerances, then the operator may proof the cylinder 26 using traditional proofing techniques. If the decision at decision block 154 is affirmative, then no tradition proofing is necessary (block 158) and the routine ends.

Advantageously, through use of the tool path position signal 50, a real-time virtual proofing system and method are provided that facilitates reducing or eliminating the need for traditional proofing techniques using an actual real-time signal directly in response to the actual motion or movement of the cutter, cutting stylus or tool 46. Utilizing this tool path position signal 50, the cut image can be reconstructed and then compared to the source image to determine whether or not the engrave job is acceptable and within tolerance.

Other advantages of the proofing system 12 include:

- the ability to eliminate traditional proofing in order to save costs and time;
- the ability to catch mistakes earlier in the process;
- the ability of customers could offer their cylinders at two price levels—a lower cost with a virtual proof, or a higher cost with a traditional proof;
- the ability to evaluate the quality of engraving. For example head drift, ring and hysteresis will all show up which allows the operator to perform maintenance and improve these errors;
- differentiates the proofing system 12 from other manufacturers in the market.

While the method, system and apparatus described herein constitute preferred embodiments of this invention, it is to be understood that the invention is not limited to this precise method, system and apparatus, and that changes may be made in either without departing from the scope of the invention, which is defined in the appended claims.

What is claimed is:

1. A proofing system for proofing an image engraved on a gravure cylinder;

at least one sensor for sensing movement of a cutter or cutter holder during engraving of a plurality of engraved cells in response to a source image file associated with a source image and for generating a tool path position signal in response thereto;

wherein said tool path position signal is in proportion to said movement of said cutter or said cutter holder;

a tool path proofing circuit for receiving said tool path position signal and for generating a pixel data signal in response thereto; and an engraver tool position reconstructed image generator analysis computer for generating an engraver tool position reconstructed image in response to said pixel data signal;

said engraver tool position reconstructed image being adapted to be compared to said source image file in order to proof an accuracy of the engraving by said cutter.

2. The proofing system as recited in claim 1 wherein said source image file corresponds to a single color separation file for an engraved job.

3. The proofing system as recited in claim 1 wherein said cutter is a cutting stylus having a depth-to-width relationship defined by the formula W=2D tan (theta/2), where D=cell depth; W=cell width; and theta is a stylus angle of said cutting stylus.

4. The proofing system as recited in claim 1 wherein said tool path proofing circuit comprises a peak detect circuit for generating at least one digitized pixel value for each of said plurality of engraved cells.

5. The proofing system as recited in claim 4 wherein said at least one digitized pixel value for each of said plurality of engraved cells is generated in real time in response to engraving said plurality of engraved cells.

6. The proofing system as recited in claim 4 wherein said peak detect circuit generates a peak voltage signal that tracks said tool path position signal generated by said at least one sensor and, when the peak voltage signal is at a generally constant voltage, said peak detect circuit digitizes said peak voltage signal into said at least one digitized pixel value for each of said plurality of engraved cells, said pixel data signal comprising a plurality of said at least one digitized pixel value signals for said plurality of engraved cells, respectively.

7. The proofing system as recited in claim 6 wherein said at least one digitized pixel value is generated using a maximum voltage value and a minimum voltage value derived from at least one test cut using said engraver.

8. The proofing system as recited in claim 6 wherein said peak detect circuit comprises a A/D converter for digitizing said peak voltage signal into said at least one pixel value in response to a pixel convert signal received from said gravure engraver.

9. The proofing system as recited in claim 8 wherein said peak detect circuit comprises:

a first operational amplifier having an output coupled to a first channel of said A/D converter;

a second operational amplifier having an output coupled to a second channel of said A/D converter;

a diode and capacitor and switch coupled to and input of said second operational amplifier and configured to generate said peak voltage signal at said second channel of said A/D converter.

10. The proofing system as recited in claim 8 wherein said A/D converter comprises an output resolution of at least 12 bits.

11. The proofing system as recited in claim 1 wherein said proofing system further comprises:

an image generator for receiving said pixel data signal and for generating an engraver tool position reconstructed image in response thereto.

12. The proofing system as recited in claim 11 wherein said engraver tool position reconstructed image is generated in a form or layout similar to a form or layout of said source image file to facilitate visual or digital comparison.

13. The proofing system as recited in claim 12 wherein said engraver tool position reconstructed image is generated using a screen angle and ruling associated with the source image.

14. The proofing system as recited in claim 11 wherein said engraver tool position reconstructed image is a two dimensional grayscale image.

15. The proofing system as recited in claim 1 wherein said proofing system further comprises:

a tool position image generator analysis computer for comparing said engraver tool position reconstructed image to said source image and generates a proofing result report in response thereto.

16. The proofing system as recited in claim 15 wherein said tool position image generator analysis computer comprises metrics for determining whether any differences in said proofing result report are within tolerances and if they are not, generating a proofing alarm or notice in response thereto.

17. The proofing system as recited in claim 15 wherein said proofing result report is at least one of printed or displayed on a graphic imaging computer so that it can be viewed by an operator both in real-time as said gravure cylinder is being engraved and upon completion of an engraving job.

18. The proofing system as recited in claim 15 wherein proofing result is generated for each color separation for said source image.

19. The proofing system as recited in claim 15 wherein said tool position image generator analysis computer color mixes said engraver tool position reconstructed image for all color separation for said source image to provide a composite tool position image file.

20. The proofing system as recited in claim 19 wherein said tool position image generator analysis computer compares said composite tool position image to said source image and determines and generates a composite proofing result in response thereto.

21. The proofing system as recited in claim 20 wherein said tool position image generator analysis computer comprises metrics for determining whether any differences in said composite proofing result report are within tolerances and if they are not, generating a composite proofing alarm or notice in response thereto.

22. The proofing system as recited in claim 20 wherein said composite proofing result report is at least one of printed or displayed on a graphic imaging computer so that it can be viewed by an operator.

23. The proofing system as recited in claim 1 wherein said at least one sensor comprises an inductive sensor mounted on an engraving head of said engraver in proximity to said cutter so that it can sense movement thereof.

24. The proofing system as recited in claim 1 wherein said engraver tool position reconstructed image comprises a pixel density value for each of said plurality of cells engraved on said cylinder.

25. The proofing system as recited in claim 1 wherein said tool path circuit is such that an entire waveform is digitized at high speed such that the tool path information can be completely processed within a computer yielding such benefits as a more accurate estimate of the pixel data or a pixel whose density varies throughout a pixel shape and not one single value, a path toward accurately calculating a cell volume.

26. The proofing system as in claim 1 wherein an engrave head performance is analyzed for items such a cell ring, cell drift, cell size hysteresis or any other error between the actual and ideal cell size.

* * * * *